United States Patent [19]
Engelhart
[11] 4,318,226
[45] Mar. 9, 1982

[54] SCRIBING COMPASS FOR MARKING LOGS FOR NOTCHING AND FITTING

[76] Inventor: Harold J. Engelhart, 56 Beech Ct., Babbitt, Minn. 55706

[21] Appl. No.: 209,474

[22] Filed: Nov. 24, 1980

[51] Int. Cl.[3] ..... B43L 13/02
[52] U.S. Cl. ..... 33/41 E; 33/334
[58] Field of Search ..... 33/41 E, 42, 27 B, 451, 33/373, 334, 372

[56] References Cited

U.S. PATENT DOCUMENTS

| | | | |
|---|---|---|---|
| 385,822 | 7/1888 | Nutting | 33/27 B |
| 625,019 | 5/1899 | Cardell | 33/382 |
| 2,158,210 | 5/1939 | Zimowske | 33/41 E |
| 2,541,366 | 2/1951 | Kennedy | 33/373 |
| 2,827,701 | 3/1958 | Goehring | 33/41 E X |
| 2,968,098 | 1/1961 | Collin | 33/41 E |
| 3,568,322 | 3/1971 | Showers | 33/382 X |
| 4,079,520 | 3/1978 | Davis | 33/334 |
| 4,154,001 | 5/1979 | Serafin | 33/373 |

FOREIGN PATENT DOCUMENTS

| | | | |
|---|---|---|---|
| 19782 | 7/1899 | Switzerland | 33/27 B |

*Primary Examiner*—Harry N. Haroian
*Attorney, Agent, or Firm*—Raymond N. Matson

[57] ABSTRACT

A scribing compass and level combination for transferring the contour of one affixed log to another log by drawing a line where the two logs will contact without deviation of the compass from the horizontal or the vertical position.

1 Claim, 6 Drawing Figures

FIG.1
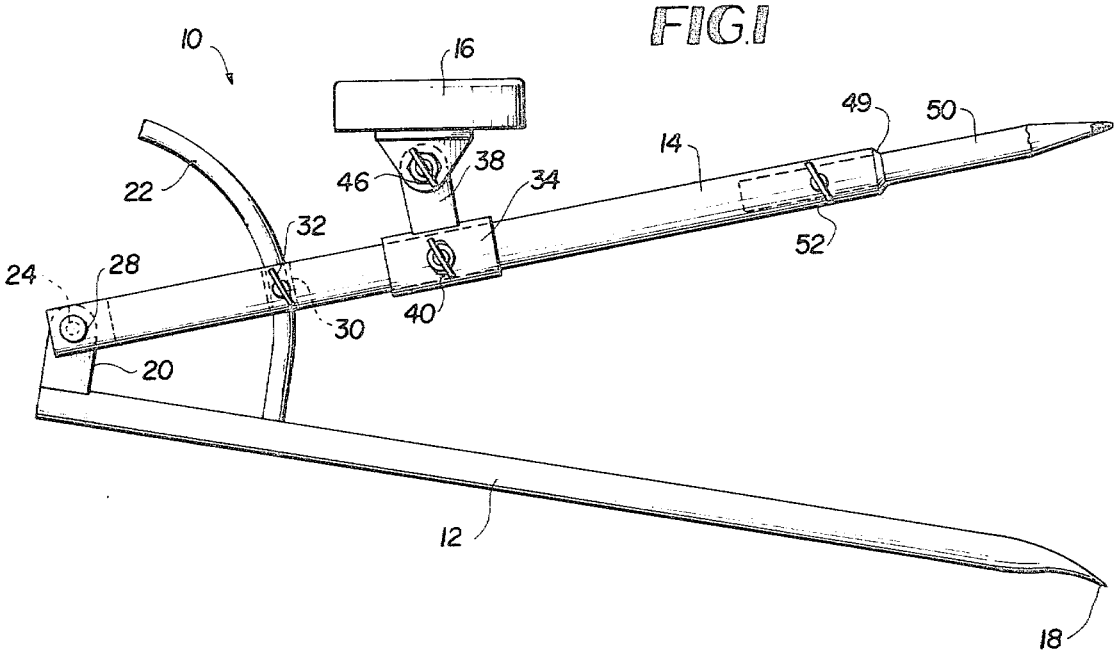
FIG.2
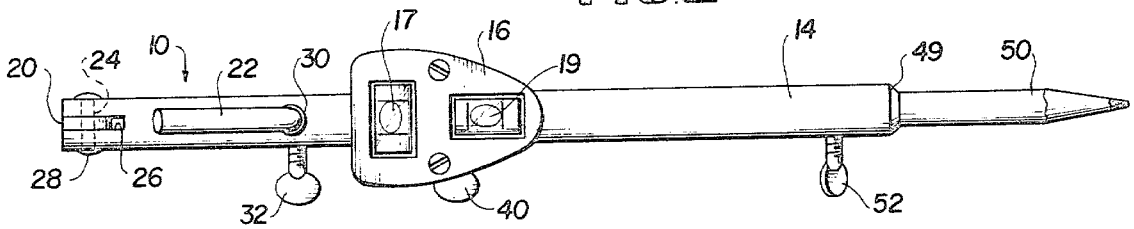
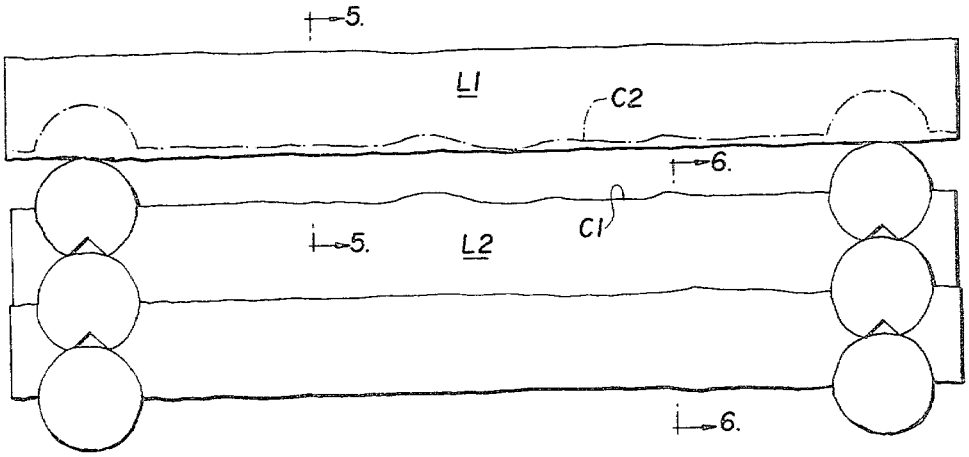
FIG.4

FIG.5
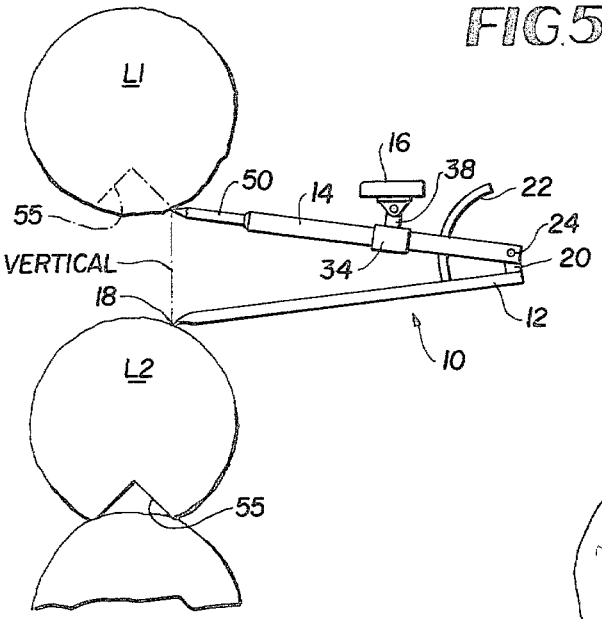
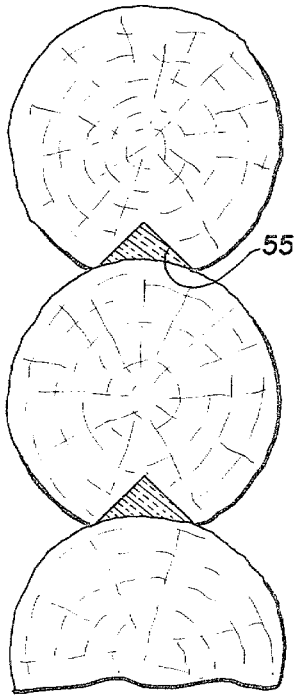
FIG.6
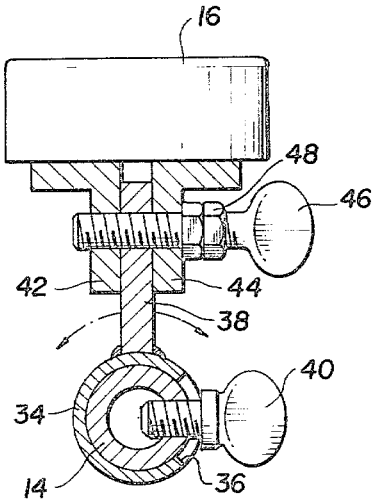
FIG.3

SCRIBING COMPASS FOR MARKING LOGS FOR NOTCHING AND FITTING

This invention relates generally to scribing compasses for the construction of a log building and more particularly to a combination scribing compass and level which will provide a precisely accurate guide line for the subsequent notching of an upper log to fit the contour of a lower log so as to eliminate the need for chinking or plastering any gaps that normally exist between the logs when less precise scribing compasses are employed.

Scribing compasses of this general type are known in the art but insofar as is known, all are characterized by one or more objectionable features. Among these are a lack of close fitting receptacles in which to insert the marking pencil and a lack of a two-way adjustable means of a level.

Accordingly, the main object of the present invention is to provide an improved scribing and level combination which will obviate the above and other objectionable features characterizing known scribing compasses.

An important object of the present invention is to provide an improved scribing compass which is durable, light weight, and which can provide an exceptionally close fit to wall logs in a single scribing and notching operation.

Another important object of the present invention is to provide an improved scribing compass and level of such precision as to eliminate excess chinking or plastering between the logs.

A further important object of the present invention is to provide a high precision scribing compass and level combination which is susceptible of ready and economic manufacture and is strong and of long life in use.

Other objects and advantages of the present invention will become apparent during the course of the following description:

In the drawings I have shown one embodiment of the invention. In this showing:

FIG. 1 is a side elevational view of the scribing compass and level comprising the present invention;

FIG. 2 is a top plan view thereof;

FIG. 3 is a transverse sectional view of the level and its mounting on the upper arm of the compass;

FIG. 4 is an elevational view showing how the cutaway lower portions of the logs enable them to match the upper contour of the log beneath each;

FIG. 5 is a vertical sectional view to a reduced scale taken on the line 5—5 of FIG. 4 showing a scribing compass and level in use; and FIG. 6 is an enlarged cross-sectional view of 3 mating logs in contour conforming final position.

Referring to the drawings, numeral 10 designates the combination scribing compass and level as a whole which comprises a pair of pivoted arms 12 and 14 and a double level 16 having transverse and axial bubbles 17 and 19 respectively.

As shown in FIGS. 1 and 5, the lower arm 12 comprises a round steel rod but may be of any suitable material, terminating at its free end in an outwardly curved point 18. The inner end of rod 12 is provided with an upwardly extending apertured pivot section 20 welded thereto and with an arcuate guide rod 22 having the aperture 24 as its center.

The upper arm 14 is a small pipe which may be formed of any suitable material and is apertured and slotted as at 26 to receive the pivot section 20 of the lower arm to which it is secured by a pivot pin 28. The arm 14 is apertured on opposite sides of the pipe as at 30 to permit passage of the arcuate guide rod 22 and the arms 12 and 14 may be locked in any position against pivoting by means of a thumb screw 32 passing through the pipe 14 to bear against the guide rod 22.

A snug fitting sleeve 34 having a vertically extending side slot 36 and an upwardly extending pivot section 38 is slidably mounted on the upper arm 14 (FIGS. 1, 3 and 5) as shown to support the double level 16. The sleeve 34 may be rotated about the upper arm 14 for level adjustment which is limited by a thumb screw 40 mounted in the sleeve 14 and bearing against the outer sides of the slot 36.

The double level 16 is pivotally mounted by a couple of depending angular members 42, 44 (FIG. 3) on the pivot section 38 by means of a thumb screw 46 having a pair of hexagon nuts 48 thereon. The member 44 accommodates the thumb screw 46 with a loose fit while member 42 is threaded to provide a squeezing effect on the member 44 against the lock nuts to lock the level in adjusted position.

As shown in FIGS. 1 and 2, a tubular shaped bushing 49 is inserted and soldered into the outer end of the pipe 14 to provide a snug fit for the marking pencil, etc. 50 which is retained therein by a thumb screw 52. The scribing compass and level may be of any desired size but in practice, it has been found that 11 or 12 inches is a good length for the purpose in question.

The operation and advantages of the scribing compass and level herein described are well illustrated in FIGS. 4, 5 and 6. In FIG. 5, the combined scribing compass and double level 10 is shown in operative position for scribing logs with log L1 about to be scribed while supported about 6 to 8 inches above log L2 which has already been affixed to a supporting wall structure.

The curved point 18 of the lower leg 12 is positioned on the log L2 as shown and the legs 12 and 14 are separated until the pencil 50 engages an equivalent point on the lower surface of log L1 whereupon the wing nut 32 is tightened. The wing nut 46 is now loosened and the level 16 is pivoted forwardly or rearwardly until the bubble 19 is positioned centrally of its tube. Wing nut 46 is now tightened and wing nut 40 is loosened. The sleeve 34 is now rotated about the upper arm 14 until the bubble 17 is positioned centrally of its tube.

The axial and lateral bubble adjustment ensures that the upper contour C1 of the log L2 is accurately transferred by the pencil 50 to the lower surface of the log L1 as indicated at C2 in FIG. 4, as the point 19 is drawn along the log C1. It will be readily apparent that, as the contour is marked on the log L1 by the pencil 50 along the length of the log, any deviation of the bubbles 17 and 19 from their central positions will produce inaccuracies in the transferred contours. The other side of the log is similarly marked, the log L1 removed and the wood in area 55 is chipped out. If desired, the chipped out area may be filled with insulation, etc. before the log L1 is laid in final position on the log L2.

It is now readily apparent in view of the tremendously increasing popularity of log buildings, that the combined scribing compass and level 10 of the present invention is unique in its ability to provide a precisely accurate guideline on each side of an upper log for notching it for a near precision fit with its supporting lower log to thus eliminate the need for chinking or plastering any gaps such as normally exist when a less precision scribing tool is used.

It is to be understood that the form of my invention herewith shown and described is to be taken as a preferred example of the same and that various changes in the shape, size and arrangement of parts may be resorted to without departure from the spirit of the invention or the scope of the subjoined claims.

What is claimed is:

1. In combination, a scribing compass comprising a single pair of rigid pivoted arms adapted to engage the surface of a pair of vertically spaced logs for longitudinally marking the upper surface contour of the lower log on the lower surface of the upper log; one of said arms terminating in an outwardly curved point and its inner end having an upwardly apertured pivot section fixed thereto; an arcuate guide rod having the aperture as its center fixed to said arm; the other of said arms being slotted and apertured at its inner end and being pivoted to said pivot section; said other arm being apertured to receive said arcuate guide rod and including means for locking said arms by said rod in any adjusted position; a sleeve including a vertically extended pivot section and side slot mounted on said other arm and being rotatably adjustable thereabout; said sleeve being secured in adjusted position by a thumb screw mounted in said arm and bearing against the sides of said slot; a double level pivoted axially of said arm on said sleeve pivot section and having means for securing it in adjusted position; said level having bubbles arranged axially and transversely thereof; and marking means adjustably mounted in the outer end of the other of said arms in vertical alignment with said curved point.

* * * * *